US009032745B2

(12) United States Patent
Ashrafzadeh et al.

(10) Patent No.: US 9,032,745 B2
(45) Date of Patent: May 19, 2015

(54) ICE IMAGING SYSTEM

(75) Inventors: Farhad Ashrafzadeh, Stevensville, MI (US); Kevin M. Chase, Saint Joseph, MI (US); Brian P. Janke, Ann Arbor, MI (US); Shreecharan Kanchanavally, Lisle, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 1389 days.

(21) Appl. No.: 12/550,722

(22) Filed: Aug. 31, 2009

(65) Prior Publication Data

US 2009/0314016 A1 Dec. 24, 2009

Related U.S. Application Data

(63) Continuation-in-part of application No. 11/741,344, filed on Apr. 27, 2007.

(51) Int. Cl.
*F25C 1/00* (2006.01)
*F25C 5/18* (2006.01)

(52) U.S. Cl.
CPC ..... *F25C 5/187* (2013.01); *F25C 2400/10* (2013.01)

(58) Field of Classification Search
USPC ..... 62/137, 135, 344, 125, 126; 382/110, 382/115
See application file for complete search history.

(56) References Cited

U.S. PATENT DOCUMENTS

| | | | | |
|---|---|---|---|---|
| 4,822,996 | A | 4/1989 | Lind | |
| 4,938,030 | A | 7/1990 | Josten et al. | |
| 5,501,367 | A | 3/1996 | Chigira | |
| 5,901,561 | A | 5/1999 | Allison et al. | |
| 6,050,097 | A | 4/2000 | Nelson et al. | |
| 6,082,130 | A | 7/2000 | Pastryk et al. | |
| 6,314,745 | B1 | 11/2001 | Janke et al. | |
| 6,351,958 | B1 | 3/2002 | Pastryk et al. | |
| 6,414,301 | B1 | 7/2002 | Borg, Jr. et al. | |
| 6,511,694 | B2 | 1/2003 | Huang et al. | |
| 6,561,691 | B1 | 5/2003 | McCann et al. | |
| 6,581,392 | B1 | 6/2003 | Gist et al. | |
| 6,919,795 | B2 * | 7/2005 | Roseen | 340/309.16 |
| 2002/0002831 | A1 * | 1/2002 | Huffman et al. | 62/137 |

FOREIGN PATENT DOCUMENTS

| | | | | |
|---|---|---|---|---|
| JP | 2002-295959 A | | 10/2002 | |
| JP | 2003-42626 | * | 2/2003 | G03B 15/00 |

* cited by examiner

*Primary Examiner* — Cassey D Bauer

(57) ABSTRACT

A refrigerator includes a sensing system for detecting multiple physical characteristics of ice cubes in an ice cube storage bin. The system includes a digital image capture device coupled to a digital image analyzing system which captures digital images of the ice cube storage bin intermittently and compares the images to detect the presence of ice clumps. In addition, the digital image analyzing system evaluates the edges, ice size and/or image intensity of the ice cubes in the images in order to determine the presence of stale ice. An algorithm is utilized to estimate the volume of ice within the bin based on the number of pixels in an ice bin image, the number of pixels of the ice within the bin, and a known volume of the ice bin. Notifications for clumped ice, stale ice and ice volume within the bin are sent to a user interface.

17 Claims, 9 Drawing Sheets

ICE IMAGING SYSTEM

CROSS-REFERENCE TO RELATED APPLICATIONS

The present invention represents a continuation-in-part of U.S. patent application Ser. No. 11/741,344 filed Apr. 27, 2007, pending.

BACKGROUND OF THE INVENTION

1. Field of the Invention

The present invention pertains to the art of refrigerators and, more particularly, to a sensing system that employs digital imaging technology to determine a physical characteristic, specifically a level and/or quality, of ice cubes in an ice cube storage bin.

2. Description of the Related Art

Sensing a level of ice cubes in an ice cube storage bin is well known in the art. That is, refrigerators that employ automatic ice makers have, for years, employed a mechanism of one form or another to detect a level of ice in an ice cube storage bin. Basically, when the level of ice reaches a predetermined point, the ice maker is deactivated to prevent overflow. Most level sensing arrangements employ a bale arm that is pivotally mounted to the ice maker. The bale arm extends into the ice cube storage bin and is acted upon by ice cubes contained therein. More specifically, as the level of ice cubes in the ice cube storage bin rises, the bale is urged upward. When the level of ice cubes reaches a predetermined point, the bale arm acts upon a switch to temporarily shut off the ice maker, thereby halting ice production. When the level of ice cubes falls below the predetermined point, the bale arm moves downward, the ice maker is activated and a new ice production cycle is initiated.

Over time, manufacturers developed more advanced systems for detecting a level of ice in an ice cube storage bin. The more advanced systems were particularly developed for door mounted ice cube storage bins where the use of bale arms is inappropriate or impractical. These more advanced systems employ various types of electronic sensors, such as infrared, ultrasonic, capacitive and even weight sensors in order to determine the level of ice in the ice cube storage bin and control operation of the ice maker.

In addition to the challenges associated with sensing ice levels, there exists the problem of determining ice quality. Over time, ice in a freezer bin can become stale and develop an undesirable taste. Additionally, when ice is exposed to warm air over time, as when a freezer door is repeatedly opened and closed, individual ice cubes may melt fractionally causing shrinking of the ice. Furthermore, individual ice cubes may refreeze to other cubes, forming clumps of ice which are not easily utilized or discharged from an automatic ice dispenser.

Based on the above, there exists a need for further advancements in ice level sensing. More specifically, there exists a need for a more versatile ice level sensing system that employs digital imaging technology and which is capable of sensing a level of ice cubes and/or a quality of the ice cubes in an ice cube storage bin.

SUMMARY OF THE INVENTION

The present invention is directed to a refrigerator including a cabinet having top, bottom, rear and opposing side walls that collectively define a refrigerator body having a freezer compartment. The refrigerator further includes a door mounted to the cabinet for selectively providing access to the freezer compartment. The freezer compartment is provided with an ice maker, with the formed ice being stored in an ice cube storage bin. In accordance with the invention, the refrigerator employs an ice cube sensing system that utilizes digital images to determine a physical characteristic, particularly the amount and/or quality, of ice cubes in the ice cube storage bin.

More specifically, the ice cube sensing system employs a digital image capture device which is focused upon the ice bin. The digital image capture device is coupled to a digital image analyzing system that captures digital images of the ice cube storage bin intermittently and compares the images to detect the presence of ice clumps. Specifically, if ice in one area of the bin is maintained at a constant level while the level of ice in another area is simultaneously decreasing, the system assumes the area having the constant level of ice is clumped. In addition to detecting ice clumps, the digital image analyzing system evaluates edge contours, overall size and/or intensity of ice cubes in the images to indicate the presence of stale ice.

In further accordance with the present invention, the digital image capture device can be utilized to estimate the volume of ice within the ice bin. More specifically, the number of pixels in an ice bin image is evaluated, the ice is defined as the region of interest, and the number of pixels of the ice by itself is evaluated. The digital image analyzing system compares the amount of pixels in the original image with the amount of pixels of the ice by itself, and an algorithm is utilized to estimate the volume of ice in the bin and volume of empty space in the bin based on a known ice bin volume. The system is also adapted to provide notifications for clumped ice, shrunken ice and ice volume within the bin to a user interface.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
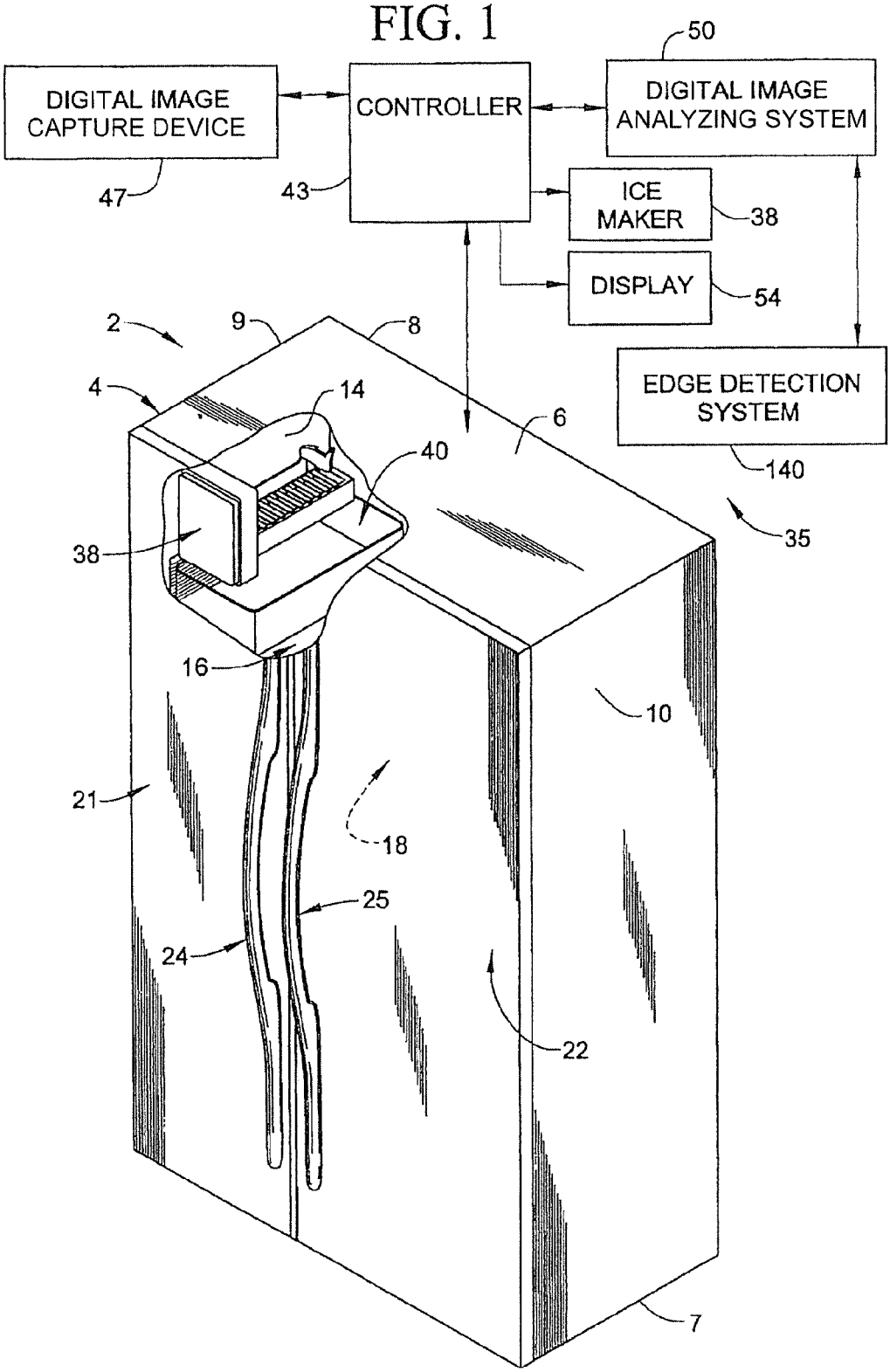
FIG. 1 is an upper left perspective view of a refrigerator incorporating an ice level and quality sensing system constructed in accordance with the present invention.

As best shown in FIG. 1, a refrigerator constructed in accordance with a first embodiment of the present invention is generally indicated as 2. Refrigerator 2 includes a cabinet 4 having a top wall 6, a bottom wall 7, a rear wall 8 and opposing sidewalls 9 and 10 that collectively define a refrigerator body. Refrigerator 2 is further shown to include a liner 14 that defines a freezer compartment 16. A fresh food compartment 18 is arranged alongside freezer compartment 16 such that refrigerator 2 defines a side-by-side model. Of course, it should be understood that the present invention can be readily incorporated into various refrigerator models, including top mount, bottom mount and French-style door model refrigerators. At this point, it should also be understood that the referenced freezer compartment 16 could be constituted by a dedicated ice producing section provided in the fresh food compartment. In any case, in the exemplary embodiment shown, refrigerator 2 includes a freezer compartment door 21 and a fresh food compartment door 22 pivotally mounted to cabinet 4 for selectively providing access to freezer compartment 16 and fresh food compartment 18 respectively. In a manner also known in the art, each compartment door 21, 22 includes a corresponding handle 24, 25.

In accordance with the invention, refrigerator 2 is provided with an ice making system 35 including an automatic ice maker 38 positioned above a transparent ice cube storage bin 40. As will be discussed more fully below, ice making system 35 automatically detects a physical characteristic, particularly a level and quality, of ice cubes contained within ice cube storage bin 40. Towards that end, ice making system 35 includes a controller 43 which receives input from a digital image capture device 47. Digital images from digital image capture device 47 are passed to a digital image analyzing system 50 which preferably determines both the level and quality of ice cubes within ice cube storage bin 40. Level data is passed to controller 43 to establish ice production cycles for ice maker 38. More specifically, if digital image analyzing system 50 determines that a level of ice cubes in ice cube storage bin 40 is below a predetermined level, controller 43 will signal ice maker 38 to continue ice production. However, in the event that digital image analyzing system 50 determines that the level of ice cubes in ice cube storage bin 40 is at or above the predetermined level, controller 43 signals ice maker 38 to cease ice production. Also, if digital image analyzing system 50 determines that the quality of ice cubes within ice cube storage bin 40 is below a predetermined level, a signal is presented on a display 54, such as an LCD display, indicating that the ice cubes should be replaced.

Figure 2:
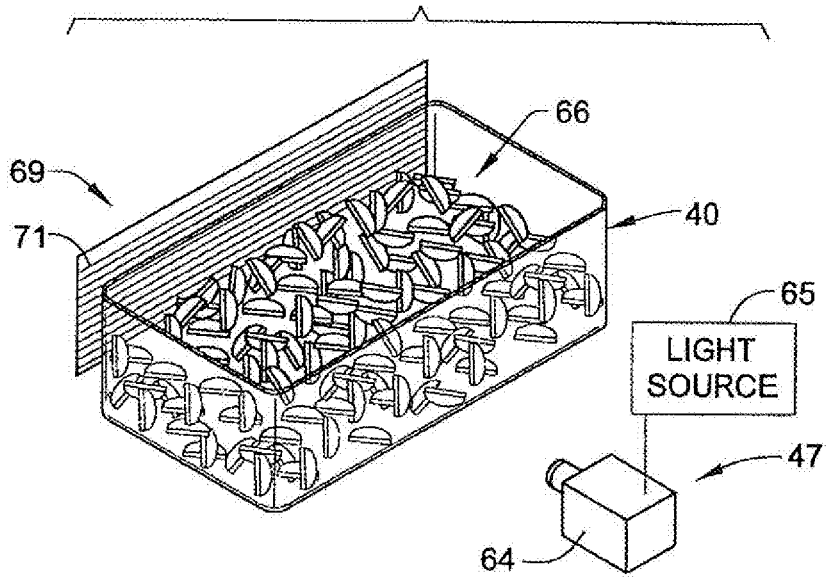
FIG. 2 is an upper right perspective view of a digital image capture portion of the ice level and quality sensing system of the present invention.
Figure 3:
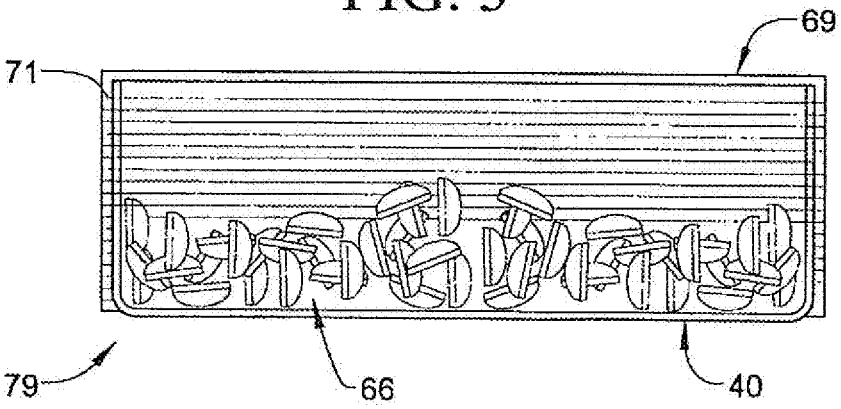
FIG. 3 is a side elevational view of an ice bin illustrating ice cubes contrasted against a referenced image.
Figure 4:
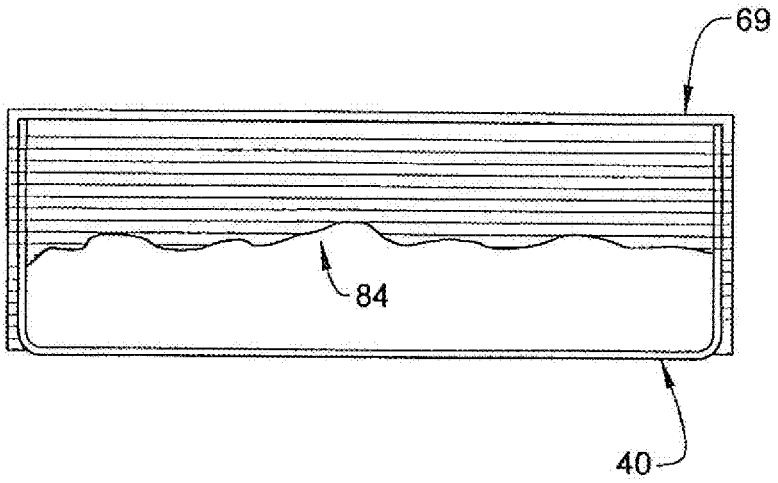
FIG. 4 is a side elevational view illustrating a level indication captured by the digital image capture device of FIG. 2.
Figure 5:
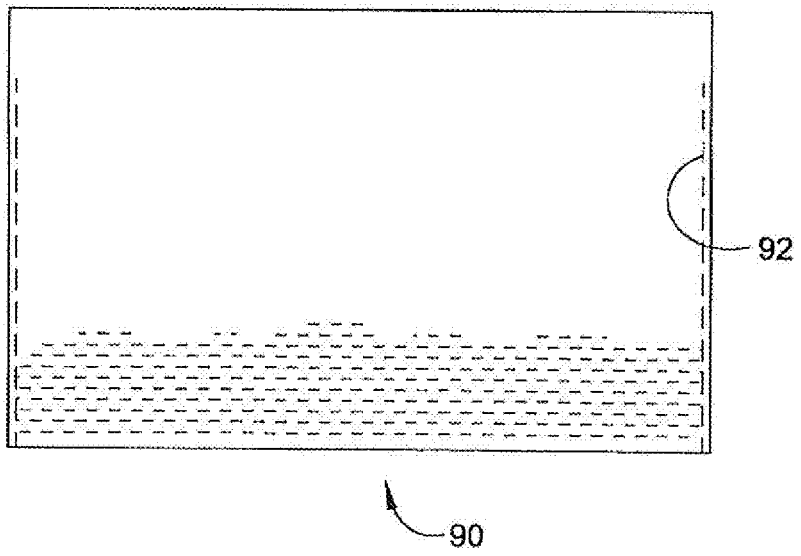
FIG. 5 is a mathematical representation of a level of ice contained within an ice cube storage bin.

As best shown in FIG. 2, digital image capture device 47 takes the form of a digital camera 64 having sufficient insulation (not shown) so as to protect digital camera 64 from the cold temperatures of freezer compartment 16. Digital camera 64 can take on a variety of forms, such as a charged/coupled device (CCD) camera or complimentary metal oxide semiconductor (CMOS) camera. Digital camera 64 is preferably operatively connected to a light source 65 which produces light of one or more wavelengths. That is, light source 65 can bathe ice cube storage bin 40 in white light, colored light or non-visible light depending upon a particular parameter of interest. Preferably, light source 65 provides only a short period of light (i.e., a flash of light) and requires only minimal power consumption. In any case, digital camera 64 is operated to capture digital images of ice cubes 66 stored within ice cube storage bin 40. In a first embodiment depicted in FIGS. 2-4, ice cubes 66 are contrasted against a reference image 69 for clarity. More specifically, in order to provide an appropriate background, ice bin 40 is arranged between reference image 69 and digital camera 64. In the embodiment shown, reference image 69 includes multiple distinct regions 71 which repeat within reference image 69. However, reference image 69 could also be a solid image or simply any desired image chosen to provide contrast for ice cubes 66. In the depicted embodiment, digital camera 64 is positioned to capture a side view 79 of ice cube storage bin 40, such as shown in FIG. 3, to develop an image profile 84 of ice cubes 66 such as shown in FIG. 4. As will be discussed more fully below, image profile 84 is passed to digital image analyzing system 50. Analyzing system 50 creates a mathematical representation 90 of image profile 84 for evaluation purposes as illustrated in FIG. 5. Mathematical representation 90 includes a level indicator or metric 92 which enables analyzing system 50 to determine an actual level of ice cubes 66 in ice cube storage bin 40.

Figure 6:
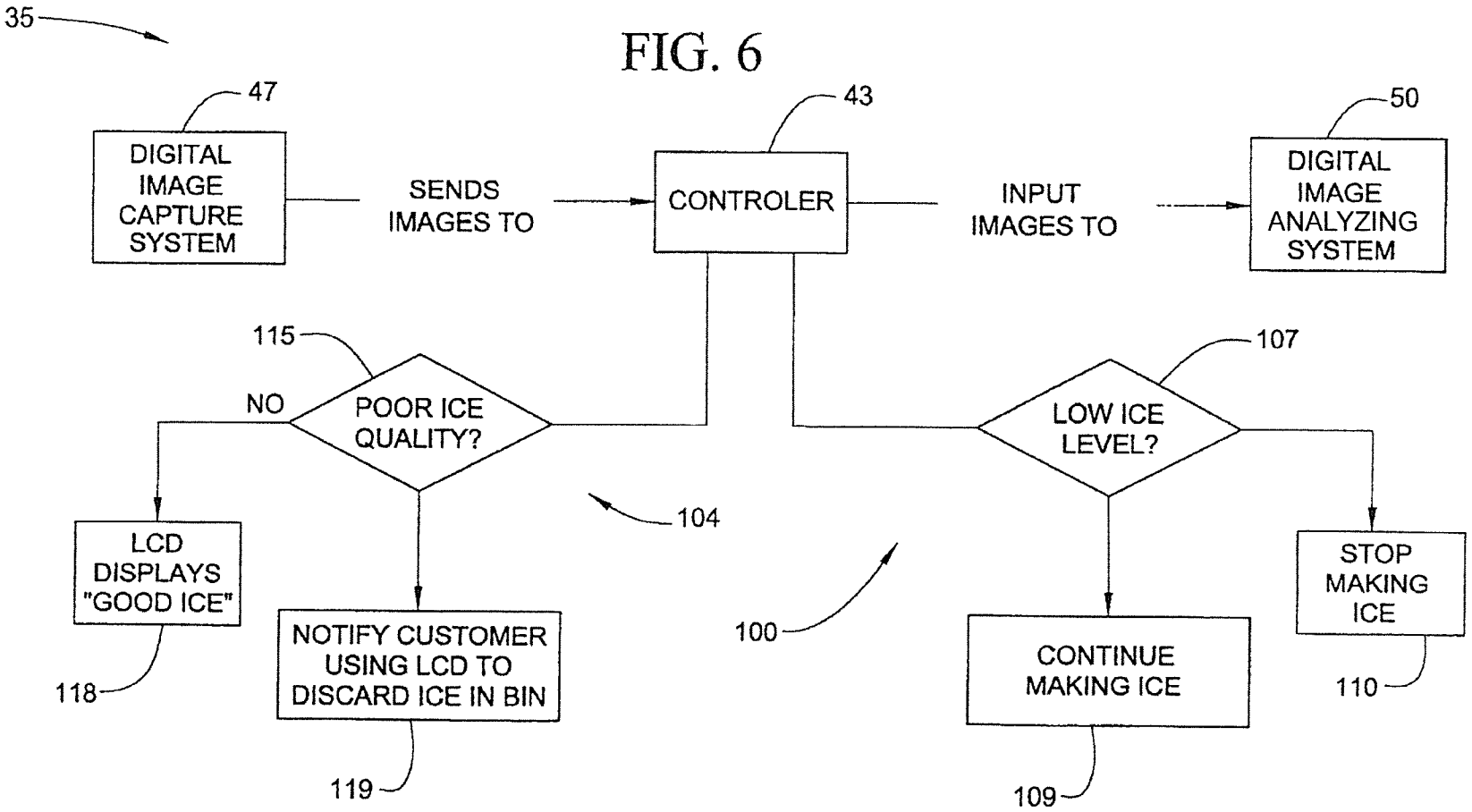
FIG. 6 is a flow chart illustrating an ice level and quality sensing algorithm employed in the present invention.

Reference will now be made to FIG. 6 in describing the operation of ice making system 35 with respect to a first ice sensing method of the present invention. As shown, ice making system 35 includes a first or level analysis portion 100 and a second or quality analysis portion 104. As will be detailed more fully below, level analysis portion 100 determines the particular level of ice cubes 66 within ice cube storage bin 40. More specifically, digital image capture device 47 periodically captures and sends digital images, such as shown in FIG. 4, to controller 43. Controller 43 passes the digital images to digital image analyzing system 50 which produces mathematical representation 90. At this point, analyzing system 50 determines an ice level in ice cube storage bin 40. The result is passed back to controller 43 for review in step 107. If the level of ice is below a predetermined level, controller 43 signals ice maker 38 to continue making ice in block 109. If, however, the level of ice is at or above the predetermined, desired level, controller 43 signals ice maker 38 to cease ice production at 110.

As noted above, in addition to determining a level of ice within ice bin 40, ice making system 35 is also capable of determining a quality of the ice within ice cube storage bin 40. As will be detailed more fully below, if controller 43 determines the quality of ice within ice cube storage bin 40 at 115. If the quality of ice is acceptable, display 54 will indicate that the ice is fresh at 115. If the quality is poor, a signal is passed to display 54 indicating that ice cubes 66 should be discarded at 119. Thus, a user can quickly determine the amount of ice available as well as the quality of ice within freezer compartment 16 without the need to open freezer door 21. If the quality of ice is poor, the user may then discard the ice and ice maker 38 will produce fresh ice which is deposited into ice storage bin 40.

Figure 7:
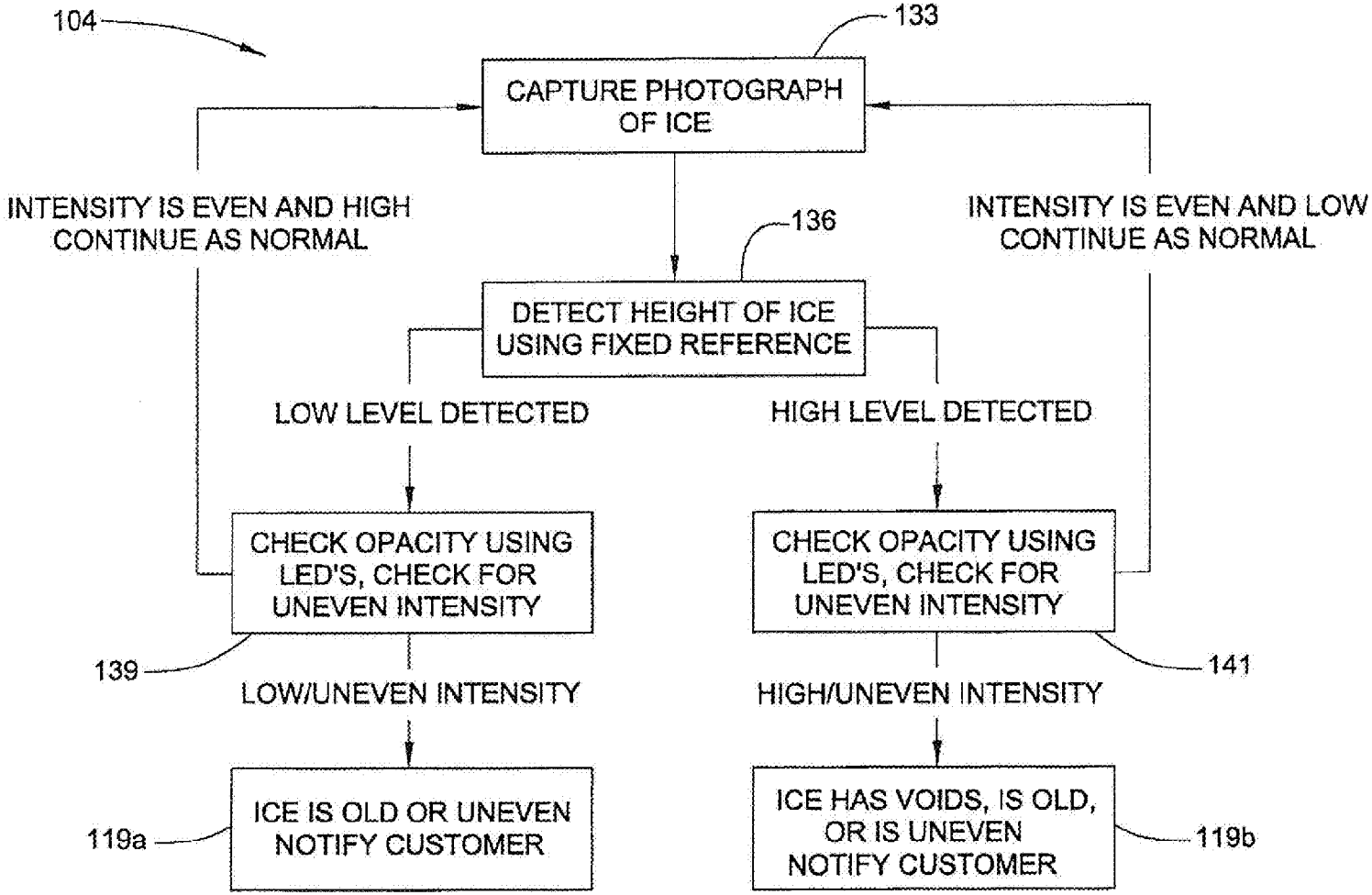
FIG. 7 is a flow chart presenting the details of the quality sensing portion of the ice level and quality sensing system of FIG. 6.

Reference will now be made to FIG. 7 in describing the particulars of quality analysis portion 104 of ice maker system 35. As shown, digital image capture device 47 first captures a photograph or digital image of ice within ice cube storage bin 40 in step 133. The digital image is analyzed by digital image analyzing system 50 to determine a level of ice cubes within ice cube storage bin 40 in step 136. If the level of ice cubes is low, digital camera 64 activates light source 65 which bathes ice cubes 66 in light and a new digital image is captured in step 139. The new digital image is passed back to digital image analyzing system 50 for analysis. Analyzing system 50 includes an edge detection portion 140. Edge detection portion 140 employs an edge detection algorithm to determine if edge portions of ice cubes 66 are sharp (indicating that the ice is fresh) or rounded (indicating that the ice cubes are older). Digital image analyzing system 50 also evaluates the intensity of ice cubes 66 obtained in the new digital image. If the level of ice cubes 66 is low and the intensity of the ice cubes is uneven, a determination is made that the ice cubes are old and should be discarded. As noted above, a signal is passed to display 54 in step 119*a* to notify the user that the ice cubes 66 are no longer fresh. Correspondingly, if the level of ice cubes 66 in ice cube storage bin is at or above the predetermined level, digital camera 64 activates light source 65 and captures an image of the ice cubes within ice cube storage bin 40 in step 141 using, for example, non-visible light. The image captured in step 141 is passed back to digital image analyzing system 50 for analysis. After evaluating edge portions of ice cubes 66, analyzing system 50 evaluates the intensity of the digital image. If analyzing system 50 determines that the level of ice cubes in ice cube storage bin 40 is high and the image captured in step 141 is uneven, a determination is made that the ice cubes contain voids, are old (e.g., soft with rounded edges) or uneven and should be replaced. This determination is signaled on display 54 in step 119*b*.

Figure 8:
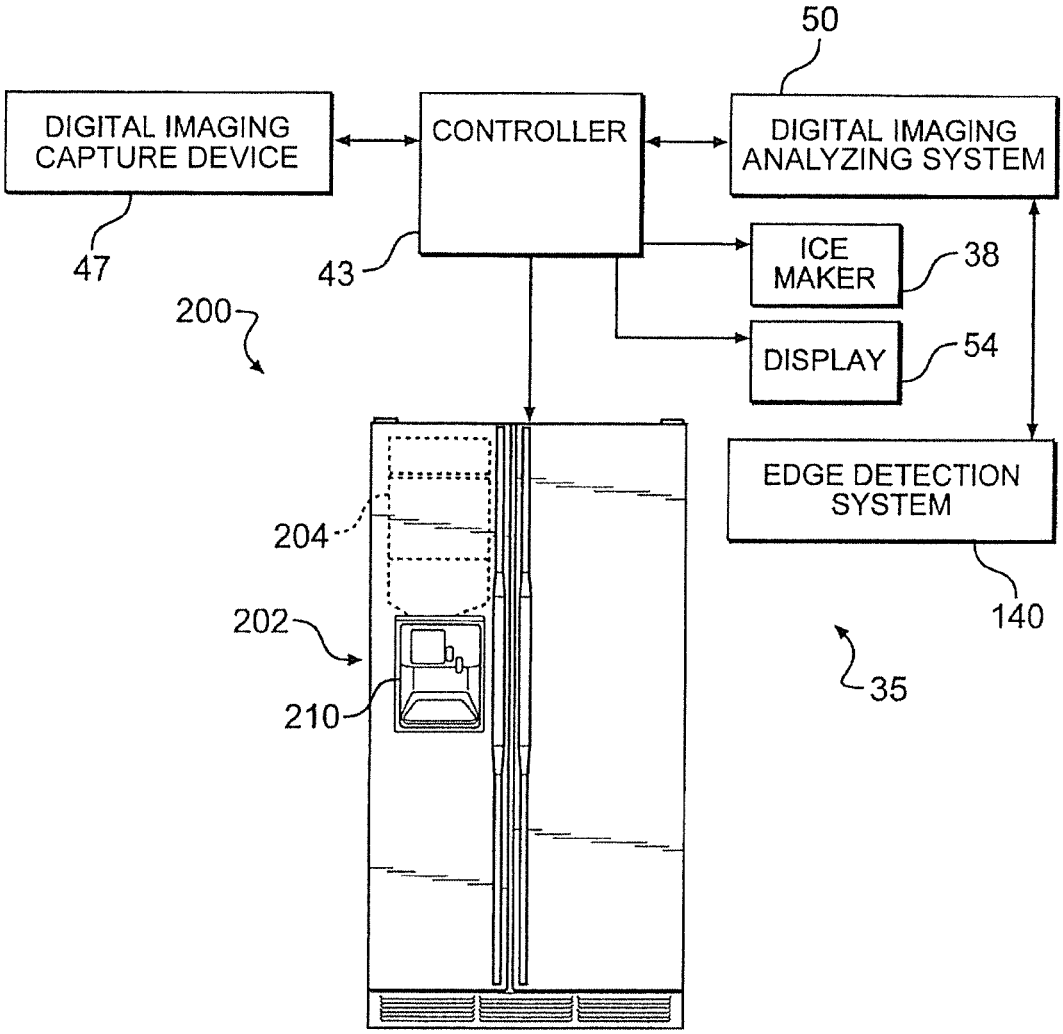
FIG. 8 is a front view of a refrigerator having a door mounted dispensing system and incorporating an ice level and quality sensing system of the present invention.
Figure 9A:
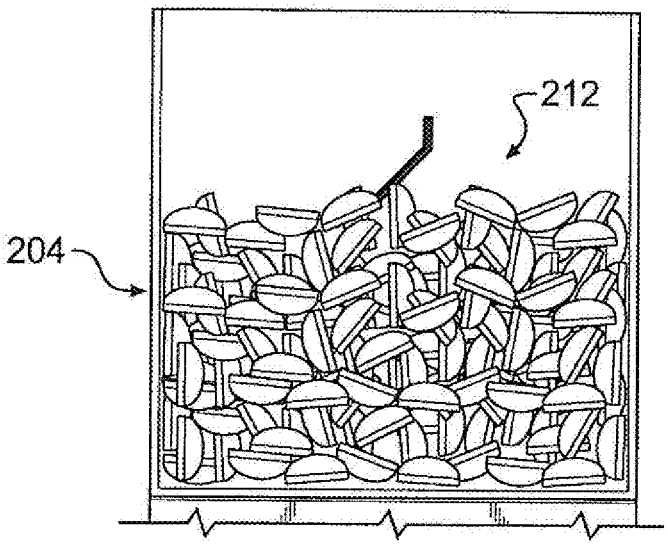
FIGS. 9A-9C illustrate the degradation in quality of ice over time and the formation of ice clumps in a door-mounted ice cube storage bin.
Figure 9B:
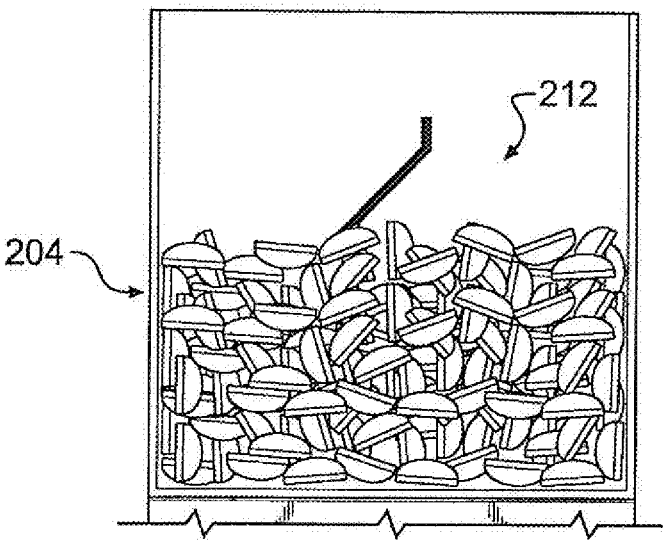
Figure 9C:
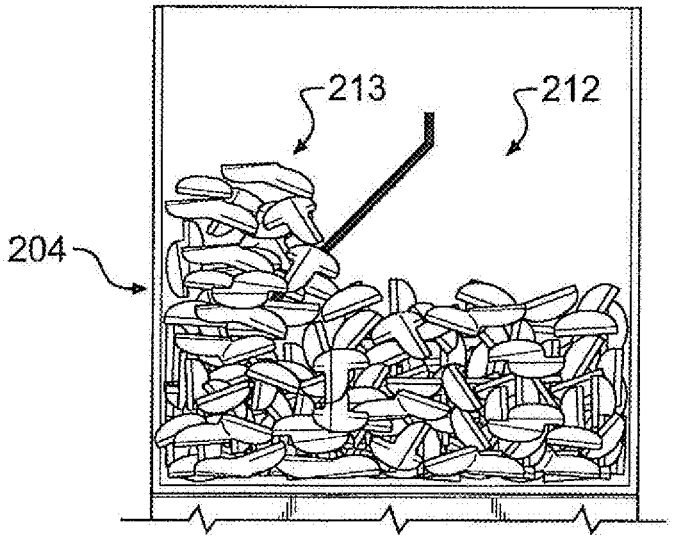

In a preferred embodiment of the present invention, digital image capture device 47 is utilized in a refrigerator 200 having an automatic ice dispensing system 202 including an ice dispensing bin 204 and a door-mounted ice dispenser 210 as depicted in FIG. 8. Automatic ice dispensing systems are well known in the art and, therefore, will not be discussed specifically. Instead, the manner in which ice making system 35 may be utilized within refrigerator 200 to determine ice shrinking and clumping will now be discussed with reference to FIGS. 8-12. During a quality-control mode of operation, digital camera 64 takes pictures of ice within dispensing bin 204 intermittently throughout the day, for example hourly, as well as every time ice dispenser 210 is actuated. The digital images are then analyzed by digital image analyzing system 50. Specifically, the digital images of ice cubes are compared to determine differences in ice characteristics from image to image. For example, FIGS. 9A-9C illustrate possible images of ice quality degradation over time in bin 204. If some of ice cubes 212 in one area of dispensing bin 204 are maintained at a constant level while another area constantly decreases, such as depicted in FIG. 9C, the system assumes that the non-moving area includes clumped ice which the system is not able to dispense. A signal is then sent to display 54 to alert a user to the presence of an ice clump 213.

Figure 10:
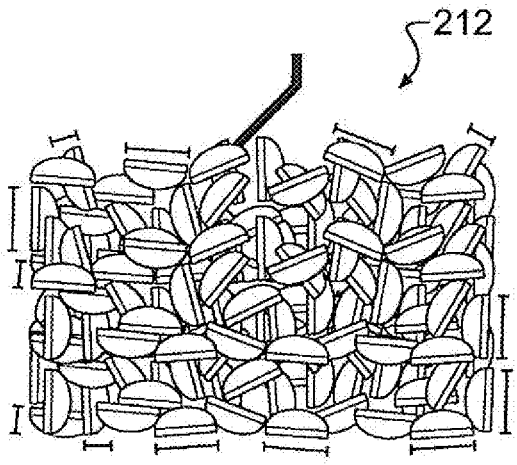
FIG. 10 illustrates the use of imaging tools of the present invention to identify and evaluate individual ice cube sizes.

Similarly, by comparing images, digital image analyzing system 50 will also detect ice shrinkage over time. That is, the digital images of ice cubes located on the outer edge of dispensing bin 204 (i.e., ice cubes in clear view of digital camera 64) are compared to determine differences in ice characteristics from image to image. For example, FIG. 10 depicts ice size characteristics for a single image taken by digital camera 64. If digital image analyzing system 50 detects that multiple ice cubes are smaller than a minimum expected cube size, then a signal will be sent to display 54 to indicate stale ice. In order to better determine ice quality and avoid false positive results, system 50 utilizes multiple image processing methods including edge detection interpolation and region of interest identification (ROI).

Figure 11:
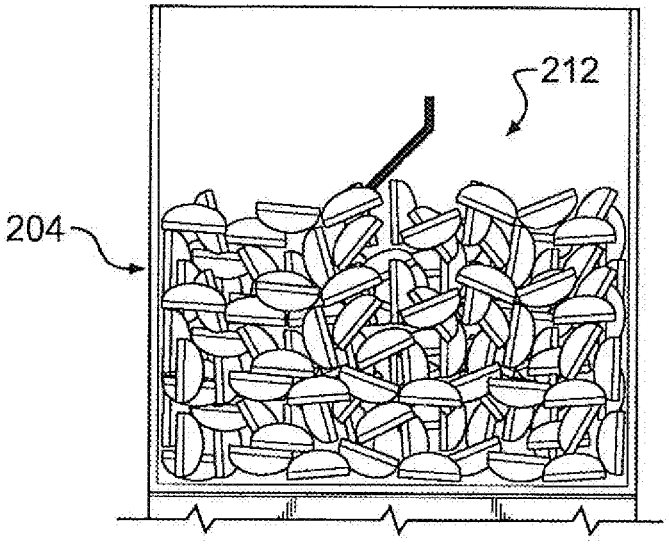
FIG. 11 illustrates the camera field of view for a first stage of a pixel counting function of the ice level and quality sensing system.
Figure 12:
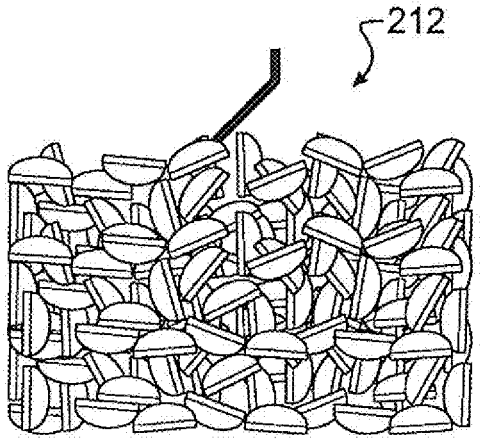
FIG. 12 illustrates the camera field of view for a second stage of the pixel counting function wherein only the ice is evaluated.

In addition to the uses described above, image capture device 47 of the present invention may be utilized to estimate a volume of ice within dispensing bin 204 using a pixel counting algorithm. In accordance with this aspect of the invention, digital image capture device 47 periodically captures and sends digital images to controller 43 and controller 43 passes the digital images to digital image analyzing system 50. System 50 then identifies the amount of pixels in the field of view of digital camera 64 to provide a reference size when comparing the amount of visible ice to the amount of visible container. More specifically, a picture of dispensing bin 204 and ice therein is first evaluated based on pixel count as seen in FIG. 11. Next, the ice is defined as the region of interest and a pixel count is done on just the ice as depicted in FIG. 12. A comparison is then made between the total amount of pixels in the original image (i.e., dispensing bin 204 plus ice cubes) and the amount of pixels of the ice by itself. These values allow the algorithm to estimate both the volume of ice in dispensing bin 204 and the volume of empty space in dispensing bin 204 based on a known fixed volume of dispensing bin 204.

The estimated volume of ice within dispensing bin 204 is preferably sent to user interface 54 and displayed to the user. Additionally, as mentioned above, digital image analyzing system 50 preferably communicates an alert to user interface 54 when stale ice or ice clumps are detected. For example, a message may appear suggesting that a user discard the ice within dispensing bin 204 when an ice clump is detected or the ice is determined to be stale. At this point, it should be understood that various user interfaces could be utilized, including an LCD display, LED array or 7-segment display, for example. Regardless of the type of alert, the digital image analyzing system 50 communicates with user interface 54 in a manner which alerts a user as to the status of ice within dispensing bin 204 without the need for the user to open the freezer door, which wastes energy and contributes to the deterioration of ice quality.

Based on the above, it should be readily understood that the present invention enables a refrigerator to automatically control ice production to ensure that consumers have an adequate or desired amount of ice. In addition to ensuring an adequate supply of ice, the sensing system of the present invention enables the quality of the ice in the ice cube storage bin to be determined. Thus, consumers are provided the option of discarding ice that may be less than fresh. Although described with reference to preferred embodiments of the invention, it should be readily understood that various changes and/or modifications can be made to the invention without departing from the spirit thereof. For instance, it should be understood that the number and location of cameras can vary in accordance with the present invention. For example, cameras can be located above, behind, alongside or even below the ice cube storage bin to capture digital images. Also, it should be noted that the particular color of light employed by the light source can vary in accordance with the present invention to include white light, various colors of light, and non-visible light in order to reveal different properties of the ice cubes. Furthermore, while shown in the main portion of the freezer compartment, the ice cube storage bin and, for that matter, the ice maker can be door mounted in the freezer compartment or, as indicated above, even provided in a dedicated freezer compartment located within the fresh food compartment of the refrigerator. Finally, the invention is not limited to dispensing model refrigerators but could be employed in models which make ice that needs to be manually removed from an ice cube storage bin. In general, the invention is only intended to be limited by the scope of the following claims.

What is claimed is:

1. A method of analyzing ice cubes in an ice cube storage bin of a refrigerator comprising:

focusing a digital image capture device, mounted in a refrigerated compartment of the refrigerator, on an ice cube storage bin;

capturing digital images of ice cubes in the ice cube storage bin; and evaluating the digital images of the ice cube storage bin captured by the digital image capture device with a digital image analyzing system to determine a physical characteristic of the ice cubes, with the physical characteristic including at least one of:

an existence of clumped ice, wherein evaluating the digital images includes analyzing the digital images to determine a quality of the ice cubes in the ice cube storage bin to determine if ice in one area of the ice cube storage bin is maintained at a relatively constant level while a level of another area is simultaneously decreasing to establish that ice in the one area is clumped; and a presence of stale ice in the ice cube storage bin, wherein evaluating the digital images includes detecting a presence of stale ice in the ice cube storage bin by evaluating edge portions of ice cubes in the ice cube storage bin to determine if the ice cubes are stale;

providing at least one of a clumped ice alert when clumped ice is detected and providing a stale ice alert when stale ice is detected.

2. The method of claim 1, wherein the physical characteristic further includes volume and evaluating the digital images includes:

evaluating a pixel count in digital images of the ice cube storage bin;

evaluating the pixel count in digital images of only a particular region of interest of the ice cube storage bin;

comparing the pixel count in the digital images of the ice cube storage bin and the pixel count in the digital images of the particular region of interest; and estimating a volume of ice in the ice cube storage bin based on the compared pixel counts.

3. The method of claim 1, further comprising: capturing and storing multiple digital images of the ice cube storage bin intermittently during a given day.

4. The method of claim 1, wherein the multiple digital images are further captured and stored after each ice dispensing event.

5. The method of claim 1, further comprising: bathing the ice cube storage bin in light prior to capturing the digital image.

6. The method of claim 2, further comprising: displaying the volume of ice on a user interface.

7. The method of claim 1, further comprising: estimating a volume of ice in the ice cube storage bin.

8. A method of analyzing ice cubes in an ice cube storage bin of a refrigerator comprising:

focusing a digital image capture device, mounted in a refrigerated compartment of the refrigerator, on an ice cube storage bin;

capturing digital images of ice cubes in the ice cube storage bin;

evaluating the digital images of only a particular region of interest of the ice cube storage bin captured by the digital image capture device with a digital image analyzing system to determine a physical characteristic of the ice cubes, with the physical characteristic including at least one of volume, an existence of clumped ice and a presence of stale ice in the ice cube storage bin; and when the physical characteristic is volume, displaying the volume of a user interface;

when the physical characteristic is existence of clumped ice, providing a clumped ice alert; and when the physical characteristic is stale ice, providing a stale ice alert when stale ice is detected.

9. The method of claim 8, wherein the physical characteristic constitutes volume and the method further comprises:

evaluating a pixel count in digital images of the ice cube storage bin;

evaluating the pixel count in digital images of only the particular region of interest of the ice cube storage bin;

comparing the pixel count in the digital images of the ice cube storage bin and the pixel count in the digital images of the particular region of interest; and estimating a volume of ice in the ice cube storage bin based on the compared pixel counts.

10. The method of claim 9, further comprising: analyzing the digital images to determine a quality of the ice cubes in the ice cube storage bin by:

evaluating the digital images to determine if ice in one area of the ice cube storage bin is maintained at a relatively constant level while a level of another area is simultaneously decreasing to establish that ice in the one area is clumped.

11. The method of claim 10, further comprising: capturing and storing multiple digital images of the ice cube storage bin intermittently during a given day.

12. The method of claim 10, wherein the multiple digital images are further captured and stored after each ice dispensing event.

13. The method of claim 10, further comprising: evaluating the digital images to detect a presence of stale ice in the ice cube storage bin by evaluating edge portions of ice cubes in the ice cube storage bin to determine if the ice cubes are stale.

14. The method of claim 9, further comprising: bathing the ice cube storage bin in light prior to capturing the digital image.

15. The method of claim 8, wherein evaluating the digital images includes evaluating a pixel count in the digital images of the ice cube storage bin.

16. The method of claim 7, wherein, in estimating a volume of ice in the ice cube storage bin, evaluating the digital images includes evaluating a pixel count in the digital images of the ice cube storage bin.

17. A method of analyzing ice cubes in an ice cube storage bin of a refrigerator comprising:

focusing a digital image capture device, mounted in a refrigerated compartment of the refrigerator, on an ice cube storage bin;

capturing digital images of ice cubes in the ice cube storage bin;

evaluating the digital images of the ice cube storage bin captured by the digital image capture device with a digital image analyzing system to determine a physical characteristic of the ice cubes, with the physical characteristic including volume and evaluating the digital images including:

evaluating a pixel count in digital images of the ice cube storage bin;

evaluating the pixel count in digital images of only a particular region of interest of the ice cube storage bin;

comparing the pixel count in the digital images of the ice cube storage bin and the pixel count in the digital images of the particular region of interest; and estimating a volume of ice in the ice cube storage bin based on the compared pixel counts; and displaying the volume of ice on a user interface.

* * * * *